US007520220B2

(12) United States Patent
Baek

(10) Patent No.: US 7,520,220 B2
(45) Date of Patent: Apr. 21, 2009

(54) CLICHÉ UNIT, PRINTING APPARATUS, AND PRINTING METHOD USING THE SAME

(75) Inventor: Myoung Kee Baek, Suwon-si (KR)

(73) Assignee: LG Display Co., Ltd., Seoul (KR)

( * ) Notice: Subject to any disclaimer, the term of this patent is extended or adjusted under 35 U.S.C. 154(b) by 92 days.

(21) Appl. No.: 10/934,385

(22) Filed: Sep. 7, 2004

(65) Prior Publication Data

US 2005/0028691 A1 Feb. 10, 2005

(30) Foreign Application Priority Data

Sep. 8, 2003 (KR) ..... 10-2003-0062764

(51) Int. Cl.
*B41M 1/10* (2006.01)

(52) U.S. Cl. ..... 101/170; 101/41; 101/150

(58) Field of Classification Search ..... 101/35, 101/36, 41, 150, 154, 158, 159, 160, 161, 101/162, 170, 483; 430/322, 324
See application file for complete search history.

(56) References Cited

U.S. PATENT DOCUMENTS

| | | | | |
|---|---|---|---|---|
| 1,610,827 | A * | 12/1926 | Thornton | 430/496 |
| 1,736,555 | A * | 11/1929 | Thornton | 430/357 |
| 1,758,769 | A * | 5/1930 | Thornton | 430/357 |
| 5,343,803 | A * | 9/1994 | Duchek et al. | 101/35 |
| 6,930,733 | B2 * | 8/2005 | Cho et al. | 349/44 |
| 2001/0026894 | A1 * | 10/2001 | Kim | 430/5 |
| 2004/0126714 | A1 * | 7/2004 | Ham | 430/322 |

FOREIGN PATENT DOCUMENTS

| | | | |
|---|---|---|---|
| KR | 2003057076 | A * | 7/2003 |
| WO | WO 2005056294 | A1 * | 6/2005 |

* cited by examiner

*Primary Examiner*—Ren Yan
(74) *Attorney, Agent, or Firm*—McKenna Long & Aldridge LLP

(57) ABSTRACT

A printing apparatus of the present invention includes a mother cliché having a plurality of sub-clichés and where a groove for a printing pattern is formed at each of the sub-clichés, a substrate for obtaining panels that correspond to the plurality of sub-clichés, respectively, and a printing means for printing the substrate using the mother cliché.

12 Claims, 8 Drawing Sheets

Sub-cliche for 20" panel

Sub-cliche for 15" panel

CLICHÉ UNIT, PRINTING APPARATUS, AND PRINTING METHOD USING THE SAME

This application claims the benefit of Korean Patent Application No. 2003-62764, filed on Sep. 8, 2003, which is hereby incorporated by reference for all purposes as if fully set forth herein.

BACKGROUND OF THE INVENTION

1. Field of the Invention

The present invention relates to a printing apparatus, and more particularly, to a cliché unit capable of forming a pattern using a cliché, a printing apparatus, and a printing method using the same.

2. Description of the Related Art

Recently, research into flat panel displays is ongoing. Flat panel displays include a liquid crystal display (LCD), an electro luminescence device (ELD), a plasma display panel (PDP), a vacuum fluorescent display (VFD), and the like.

Among such flat panel displays, the LCD has advantages such as low voltage operation, low power consumption, being lightweight, having a slim profile, and full color realization. Therefore, the LCD is widely used as a display in watches, calculators, computer monitors, television monitors, television sets, and hand-held terminals.

FIG. 1 is a cross-sectional view schematically showing an LCD of the related art.

Referring to FIG. 1, the related art LCD includes: a lower substrate 100 in which liquid crystal cells are arranged in a matrix configuration; an upper substrate 106 facing the lower substrate 100; and a liquid crystal layer 103 interposed between the lower substrate 100 and the upper substrate 106.

The lower substrate 100 includes: a gate electrode 115 formed on an upper surface of a first glass substrate 140 and to which a scanning signal is applied; an active layer 116; a gate insulating layer 117 that electrically isolates the active layer 116 from the gate electrode 115; a source and a drain electrodes 118 and 119 formed on an upper surface of the active layer 116 that applies data signals to the active layer; a passivation layer 120 formed on the gate insulating layer 117 including the source and the drain electrodes 118 and 119; a pixel electrode 121 connected to the drain electrode 119 through a contact hole formed in the passivation layer 120; and a first alignment layer 137 formed on the passivation layer 120 including the pixel electrode 121, for aligning liquid crystal molecules of a liquid crystal layer 103.

The active layer 116 includes a semiconductor layer 116*a* formed by deposition of amorphous silicon (a—Si) and an ohmic contact layer 116*b* doped with n+ impurities on both sides of the semiconductor layer 116*a*.

The upper substrate 106 includes: a color filter 111 including red, green, and blue sub-color filters on a second glass substrate 110; a black matrix layer 114 formed between the sub-filters to block light; a common electrode 130 made of an indium tin oxide (ITO), transparent conductor, on the color filter 111 and the black matrix layer 114, for applying a common voltage; and a second alignment layer 135 formed on the common electrode 130 to align liquid crystal molecules of the liquid crystal layer 103.

Also, the upper substrate 110 may further include an overcoat layer (not shown) formed on the color filter 111, for reinforcing adhesive force with respect to the common electrode 130 as well as performing planarization of the cooler filter 111.

To manufacture the LCD according to the related art, a pattern or a line may be formed through a photolithography process using an exposure apparatus.

However, such photolithography process requires use of a high price exposure apparatus, which causes problems that not only increase manufacturing costs but also increase manufacturing complexity.

To resolve such problems, a pattern formation method using a Gravure offset printing method has been suggested recently. The Gravure offset printing method is a printing method including placing a resist on a concave plate, scraping residual resist out, and performing printing. The Gravure offset printing method is widely used for a variety of applications such as publications, packaging, cellophane, vinyl, and polyethylene. Recently, an effort to apply the Gravure offset printing method to active LCD display devices or circuit devices has been actively sought for.

The Gravure offset printing method prints a resist on a substrate using a roller. Therefore, a desired pattern may be formed by using a roller one time on an area that corresponds to a desired display device. Accordingly, the Gravure offset printing method may be used to form various patterns on a display device, e.g., a gate line and a data line connected with a thin film transistor, a pixel electrode and a metal pattern for a capacitor, as well as the thin film transistor of the LCD.

FIGS. 2A through 2D show a method for forming a pattern using a Gravure offset printing method.

In FIG. 2A, after a groove 223 corresponding to a pattern is formed on a specific position of a cliché 228, the groove 223 is filled with a resist 225 (or ink). After a resist 225 used to form a pattern is coated on an upper surface of the cliché 228, a doctor blade 224 is moved while it contacts the cliché 228, so that the groove 223 is filled with the resist 225. So while the resist 225 fills the inside of the groove 223 by movement of the doctor blade 224, the resist 225 remaining on a surface of the cliché 228 is removed. Here; the cliché 228 may be made of a material including one of glass, metal, and plastics.

As shown in FIG. 2B, by placing the roller 227 in contact with the surface of the cliché 228 and rotating the roller 227, the resist 225 inside of the grooves 223 of the cliché is transferred to the surface of the roller 227. It is preferable that the width of the cliché 228, the width of a display device to be manufactured, and the circumferential length of the roller 227 are all identical. Therefore, as the roller 227 rotates one time on the surface of the cliché 228, all of the resist 225 inside the grooves 223 of the cliché 228 are transferred to the surface of the roller 227.

As shown in FIG. 2C, as the roller 227 is placed on the surface of an etching-target layer 229 formed on a substrate 230 and rolled, the resist 225 on the roller 227 is printed on the etching-target layer 229. Therefore, because the circumferential length of the roller 227 is the same as the width of the substrate 230, a desired resist 225 pattern may be formed on the entire surface of the substrate 230 by a one-time rotational movement of the roller 227.

Subsequently, as shown in FIG. 2D, the printed resist 225 is heated to dry so that a resist pattern 226 is formed.

As described above, in the Gravure offset printing method, after the resist pattern 226 is formed by using the cliché 228 and the roller 227, the etching-target layer 229 is etched using the resist pattern 226, so that a desired pattern is formed. Therefore, a pattern may be formed in a simple manner as compared with the photolithography process using an exposure apparatus of the related art.

The Gravure offset printing method, however, has a disadvantage. A scratch may be formed on the surface of the cliché 228 due to friction with the doctor blade 224, and as a result, a defect may be easily generated on the surface of the cliché 228. Also, such a scratch or defect is a major factor in generating a bad pattern during the formation of the resist pattern.

FIGS. 3A and 3B show a resist pattern formed on a real cliché and a substrate.

In FIG. 3A, if the cliché rubs against the doctor blade, a scratch may be generated on the surface of the cliché. If a resist pattern is formed on a substrate using a cliché with a scratch, resist in the shape of the scratch on the cliché is transferred onto the substrate.

Thus, if a resist pattern is formed using a cliché with a scratch and the scratch is transferred on the substrate, the substrate cannot be used. When a substrate for a large display is being manufactured, scratches on the cliché greatly increase the manufacturing costs.

The cliché may be manufactured using the following method that includes forming a resist pattern using a photomask on the organic film, after an organic film such as a polymer or a polyimide is deposited on a substrate made of glass, metal, or plastic and performing a dry etching with the resist pattern used for a mask.

To form a desired pattern on a large substrate, a cliché corresponding to such a substrate would also have to be manufactured to have a large size. However, the present technology has a limitation in manufacturing a cliché having a large size, and it is high cost.

SUMMARY OF THE INVENTION

Accordingly, the present invention is directed to a cliché unit capable of forming a pattern using a cliché, a printing apparatus, and a printing method using the same that substantially obviate one or more problems due to limitations and disadvantages of the related art.

An advantage of the present invention is to provide a cliché unit capable of coping with a failure by using a plurality of sub-chichés, a printing apparatus, and a printing method using the same.

Additional advantages and features of the invention will be set forth in part in the description which follows and in part will become apparent to those having ordinary skill in the art upon examination of the following or may be learned from practice of the invention. These other advantages of the invention may be realized and attained by the structure particularly pointed out in the written description and claims hereof as well as the appended drawings.

To achieve these and other advantages and in accordance with the purpose of the invention, as embodied and broadly described herein, a cliché unit has a mother cliché including a plurality of sub-clichés and where a groove for a printing pattern is formed at each of the sub-clichés.

The plurality of sub-clichés may have a different size.

The mother cliché may be formed by tiling the plurality of sub-clichés.

In another aspect of the present invention, a printing apparatus includes: a mother cliché having a plurality of sub-clichés and where a groove for a printing pattern is formed at each of the sub-clichés; a substrate for obtaining panels that correspond to the plurality of sub-clichés; and a printing means for printing the substrate using the mother cliché.

The plurality of sub-clichés and the panels may have the same size.

The printing apparatus may also include: a doctor blade for filling a resist in the inside of a groove formed on the mother cliché; and a roller for transferring the filled resist to print the same on the substrate.

In still another aspect of the present invention, a printing method using a printing apparatus includes: forming a mother cliché having a plurality of sub-clichés; filling a resist in an inside of a groove of the mother cliché; transferring the filled resist to a roller; and printing the roller on a substrate so that the transferred resist is formed on the substrate.

The step of forming the mother cliché may include the steps of: manufacturing a plurality of sub-clichés where a groove for a printing pattern is formed; and forming the mother cliché by tiling the plurality of sub-clichés.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
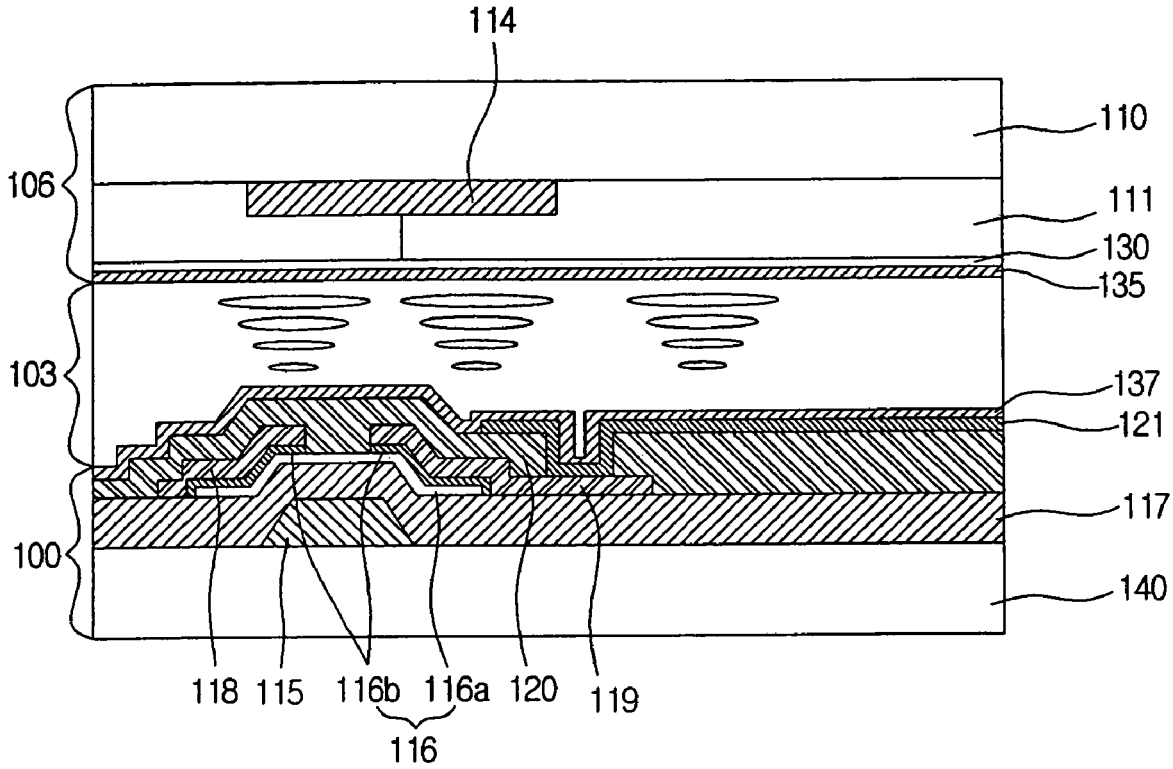
Fig.1 Related Art
FIG. 1 is a cross-sectional view schematically showing the LCD of the related art.
Figure 2A:
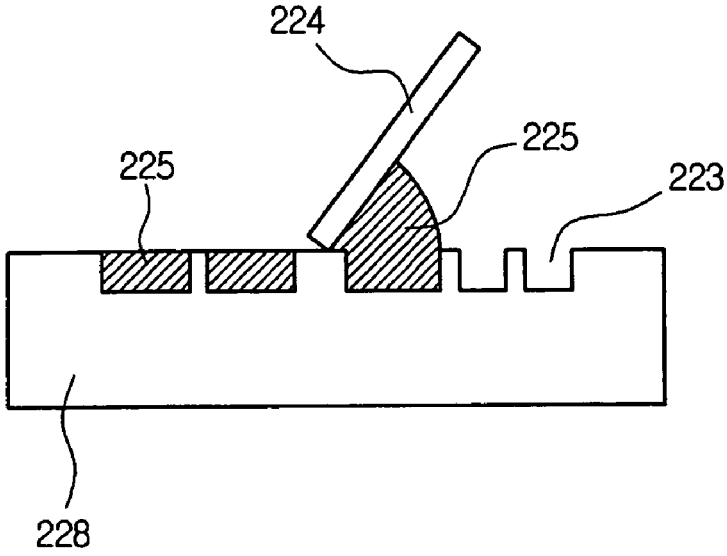
Fig.2A Related Art
FIGS. 2A through 2D show a method for forming a pattern using a Gravure offset printing method.
Figure 2B:
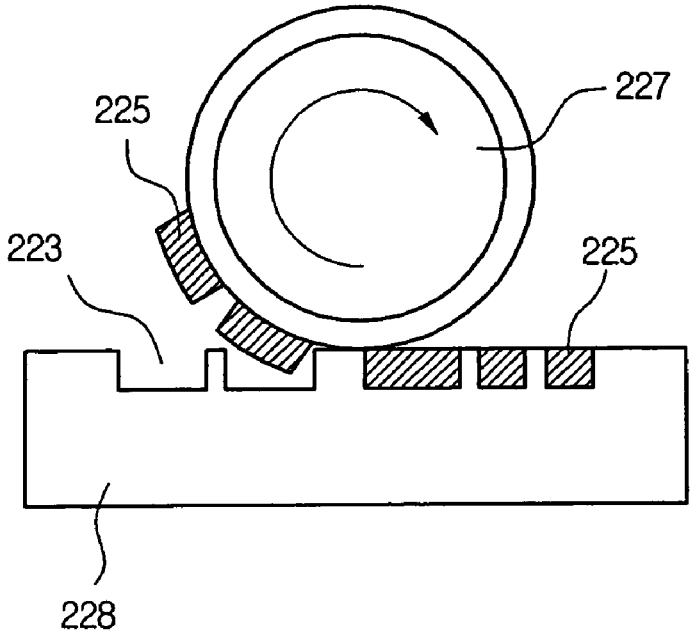
Fig.2B Related Art
Figure 2C:
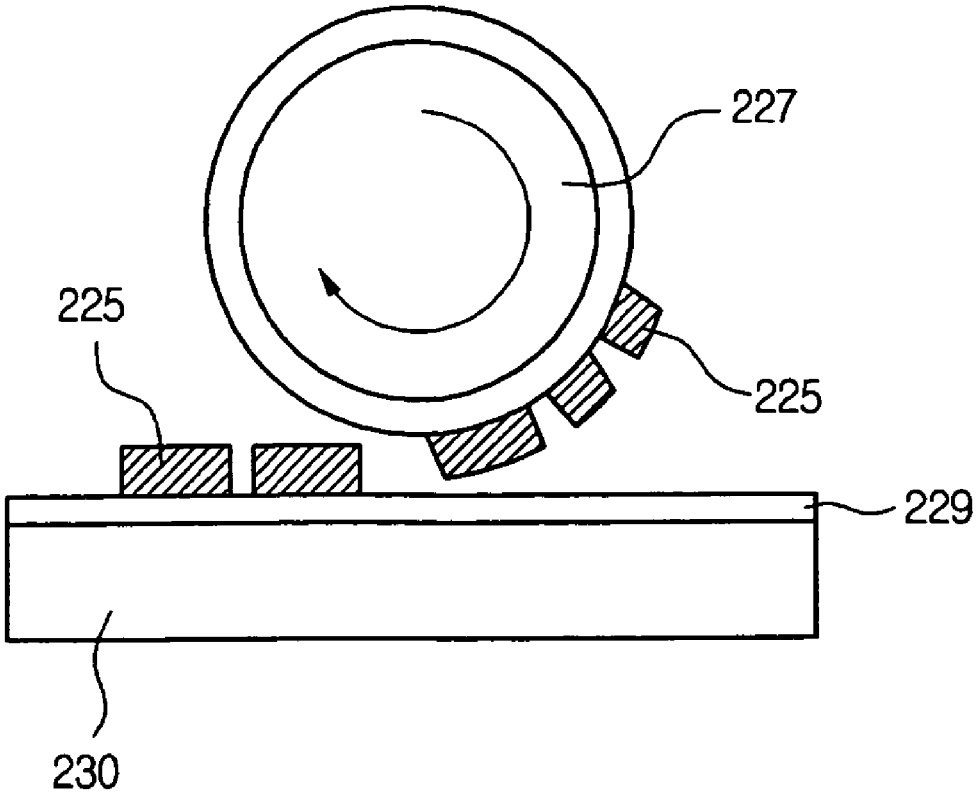
Fig.2C Related Art
Figure 2D:
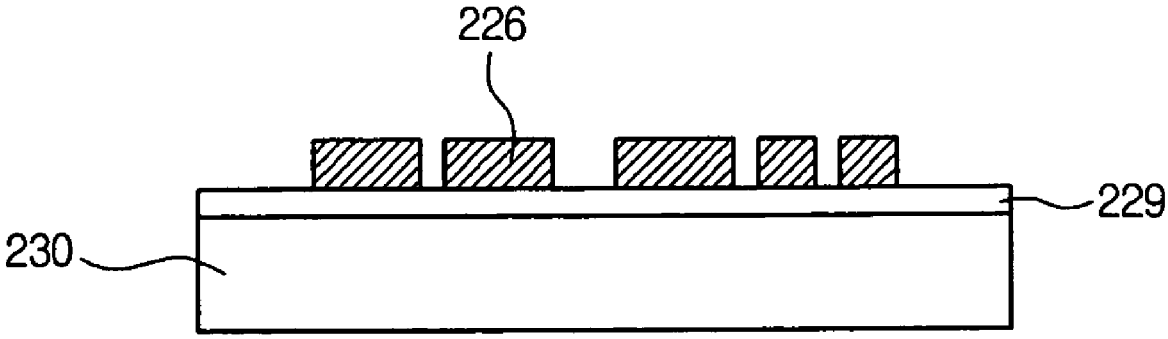
Fig.2D Related Art
Figure 3A:
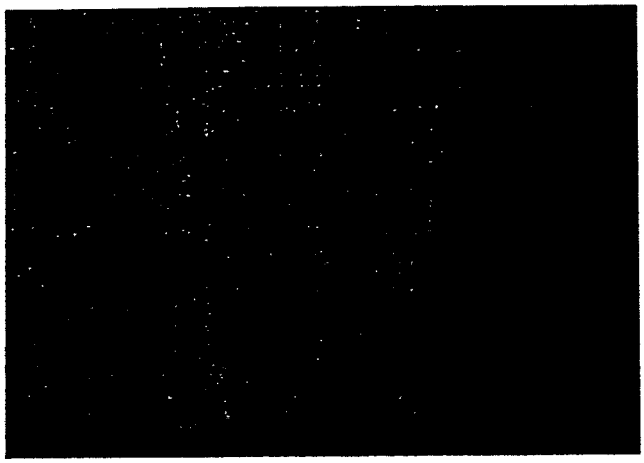
Fig.3A Related Art
FIGS. 3A and 3B show a resist pattern formed on a real cliché and a substrate.
Figure 3B:
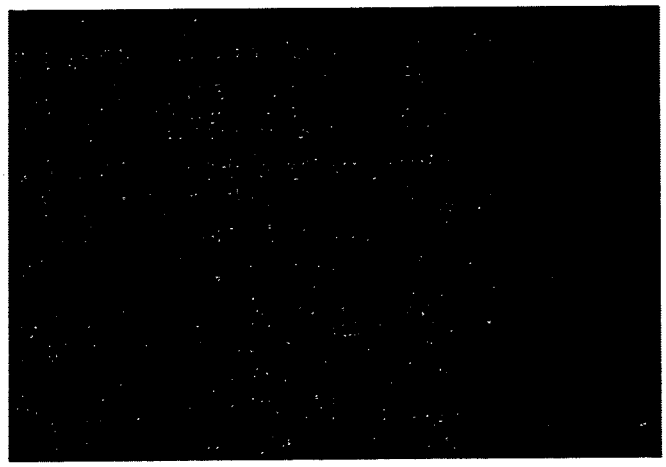
Fig.3B Related Art
Figure 4A:
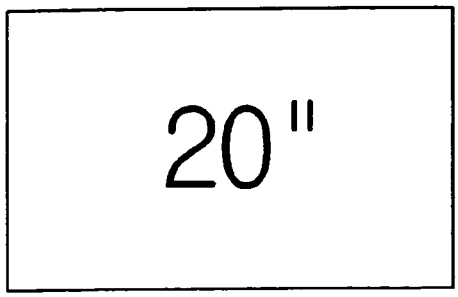
FIGS. 4A and 4B show a sub-cliché having various sizes to which the present invention is applied.
Figure 4B:
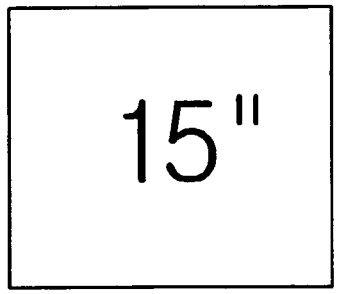

FIGS. 4A and 4B show a sub-cliché having various sizes to which the present invention is applied.

As shown in FIGS. 4A and 4B, a plurality of sub-clichés having a size of 20" and a plurality of sub-clichés having a size of 15" may provided, respectively. Sub-clichés having a smaller size or a bigger size may be manufactured if necessary.

For example, suppose that seven panels are obtained from a substrate having a size of 1000×1000, with combination of four 20"-sized panels and three 15"-sized panels.

For that purpose, four 20"-sized sub-clichés and three 15"-sized sub-clichés, are manufactured. At this point, a predetermined groove is formed on the sub-cliché.It is easy to manufacture the 20"-sized sub-cliché and 15"-sized sub-cliché.

Figure 5:
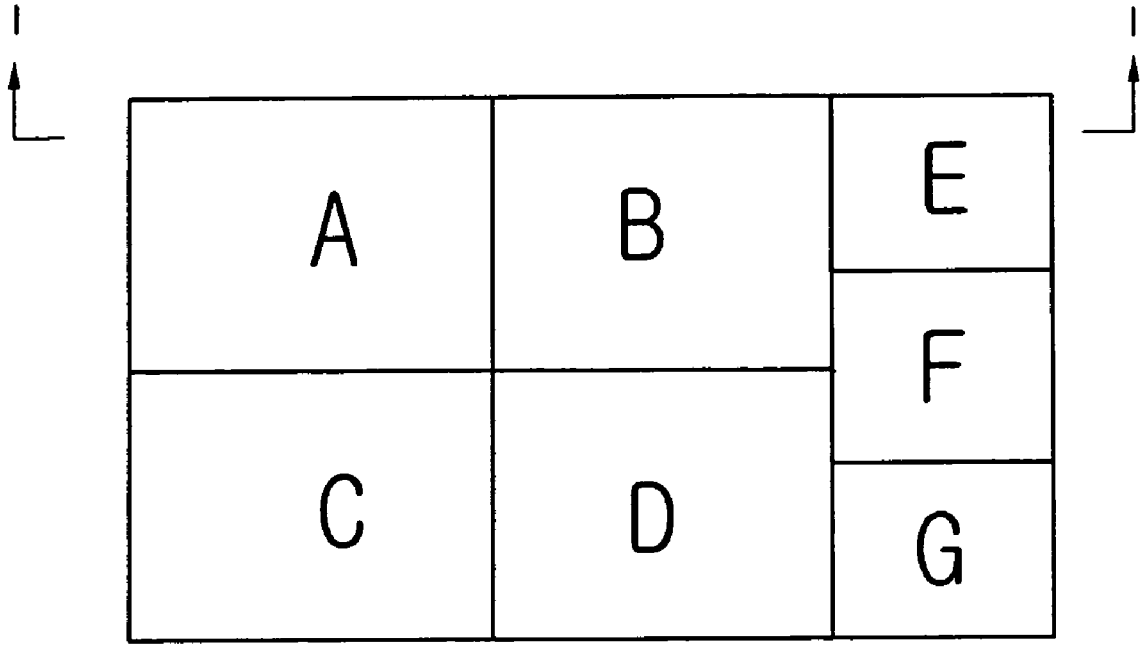
FIG. 5 shows a mother cliché manufactured using the plurality of sub-clichés of FIGS. 4A and 4B.

As shown in FIGS. 4A and 4B, if as many as required of the sub-clichés are manufactured, the four 20"-sized sub-clichés A,B,C,D and the three 15"-sized sub-clichés E,F,G are aligned, and subsequently tiled so that a mother cliché is formed as shown in FIG. 5.

FIG. 5 shows a mother cliché manufactured using the plurality of sub-clichés of FIGS. 4A and 4B.

As shown in FIG. 5, the mother cliché that corresponds to the substrate having a size of 1000×1000, is formed using the four 20"-sized sub-clichés and the three 15"-sized sub-clichés.

The tiled plurality of sub-clichés A,B,C,D,E,F,G are aligned on a stage (not shown). At this point, the stage fixes the plurality of sub-clichés A,B,C,D,E,F,G so that they may not move, by using a vacuum hole connected with a vacuum pump (not shown). Tiling is performed in this manner, with the plurality of sub-clichés A,B,C,D,E,F,G fixed, so that a resist pattern can be formed on an exact position upon formation of the resist pattern on the substrate using the sub-cliché and the roller afterwards.

Therefore, a groove is filled with a resist in advance at the mother cliché including a plurality of sub-clichés tiled in this manner, the resist is transferred to a roller, and the roller applies the resist to a surface of a substrate having a size of 1000×1000, so that a desired resist pattern is formed on the substrate. Also, an etching-target layer formed on the substrate is etched with the resist pattern used for a mask, so that a desired pattern can be formed. Also, the substrate where such a pattern is formed is cut into a panel adapted for a respective size, so that the four 20"-sized panels and the three 15"-sized panels can be obtained.

Therefore, because the mother cliché formed by tiling the plurality of sub-clichés can be constructed in various ways in response to a desired size of the substrate, there is a capability to form patterns on a variety of models.

Figure 6A:
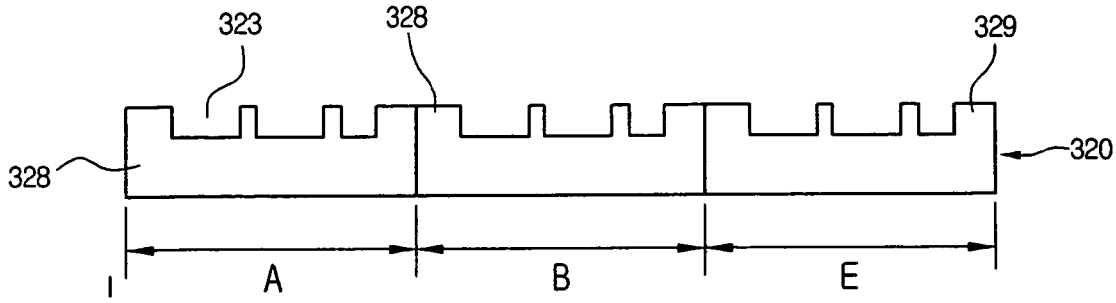
FIGS. 6A through 6E show a process for forming a pattern on a substrate using a printing apparatus according to the present invention.
Figure 6B:
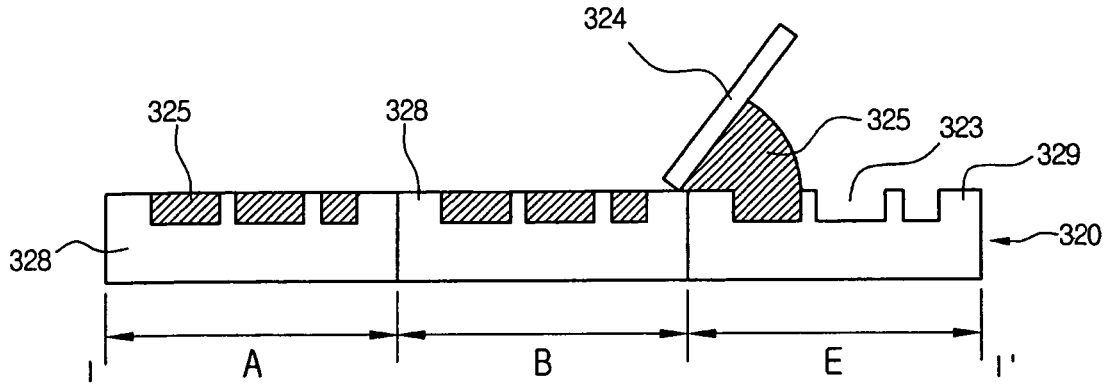
Figure 6C:
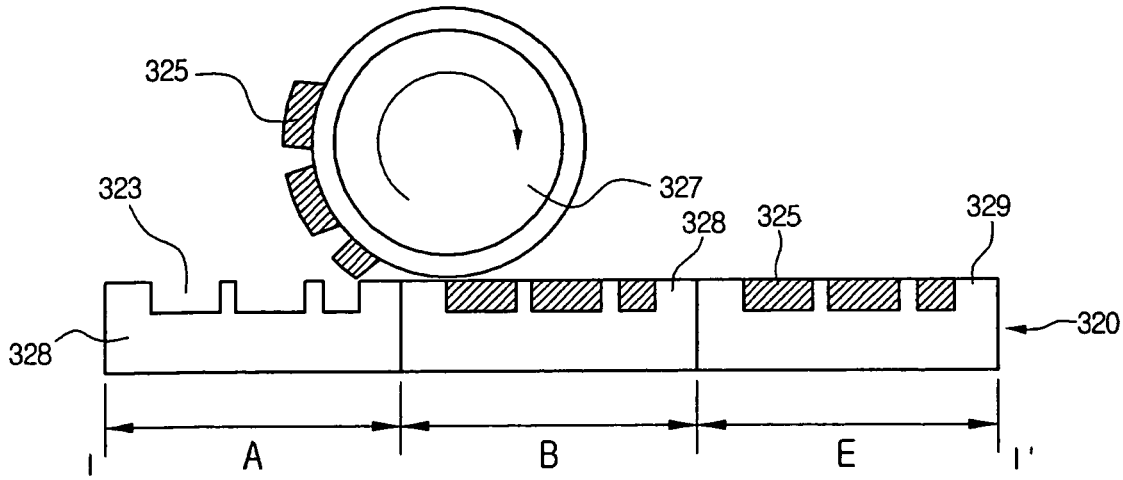

FIGS. 6A through 6E show a process for forming a pattern on a substrate using a printing apparatus according to the present invention. Here, FIGS. 6A through 6C are cross-sectional views taken along line I-I in the cliché shown in FIG. 5.

As shown in FIG. 6A, a plurality of first sub-clichés 328 having a first size and a plurality of second sub-clichés 329 having a second size are manufactured. A grooves 323 formed according to a desired pattern are provided in the first sub-cliché 328 and the second sub-cliché 329. Because such a groove 323 may be easily formed by the general method, a more detailed description thereof will be omitted. The first and the second sub-clichés 328 and 329 may be made of one of the following materials including glass, metal, or plastics. Then each of the sub-clichés 328 and 329 is manufactured so that a resist may be printed on a panel of each unit model. Namely, each of the sub-clichés corresponds to each of the panels. Therefore, though it will be explained later, the panels are manufactured using the sub-clichés 328 and 329.

After the plurality of first sub-clichés 328 and the plurality of second sub-clichés 329 manufactured in this manner are put on a stage (not shown), alignment and tiling are performed, so that a mother cliché 320 is formed. Therefore, the plurality of first sub-clichés 328 and the plurality of second sub-clichés 329 are firmly joined to the mother cliché 320. Also, the mother cliché 320 is firmly fixed in the stage by using a vacuum pump (not shown).

As shown in FIG. 6B, a resist (or ink) 325 is filled in the inside of the groove 323 formed on the mother cliché 320. After the resist 325 for forming a pattern is coated on an upper surface of the mother cliché 320, the doctor blade 324 is moved along the surface of the mother cliché 320, so that the groove 323 of the mother cliché 320 is filled with the resist 325. Therefore, the resist 325 remaining on a surface of the mother cliché 320 is completely removed.

As shown in FIG. 6*c*, the roller 327 is moved along the surface of the mother cliché 320, so that the resist 325 from the grooves 323 of the mother cliché 320 is transferred to a surface of the roller 327. It is preferable that a width of the mother cliché 320, the whole width of the substrate to be manufactured, and a circumferential length of the roller 327 are all identical. Therefore, as the roller 327 is moved along the surface of the mother cliché 320 it rotates once, the resist 325 in the grooves 323 of the mother cliché 320 is transferred to the surface of the roller 327.

Figure 6D:
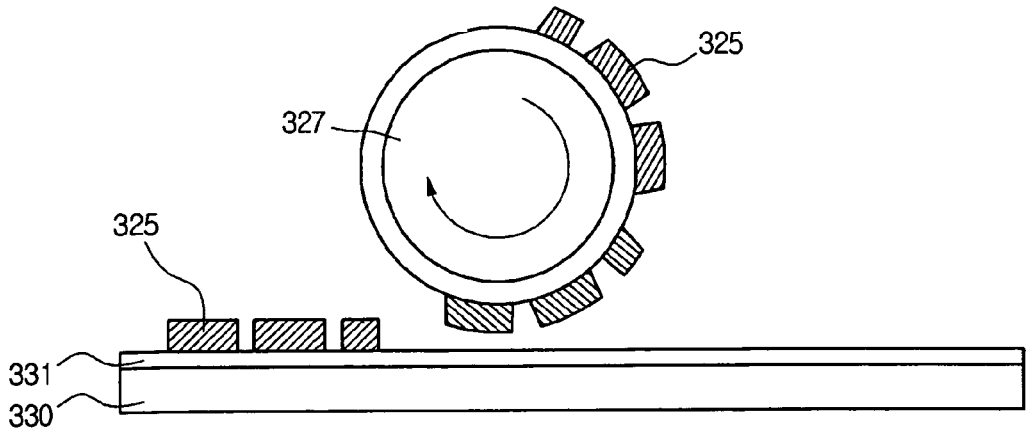

As shown in FIG. 6D, as the roller 327 is rolled along a surface of an etching-object layer 331 formed on a substrate 330 that is prepared in advance, the resist 325 transferred to the roller 327 is printed on the etching-object layer 331. Because a circumferential length of the roller 327 is identical to the whole width of the substrate 330, a desired resist pattern 325 may be formed on the whole area of the substrate 330 by a one time of rotational movement of the roller 327. Subsequently, after the printed resist 325 is heated to dry, so that a resist pattern (not shown) is formed.

Figure 6E:
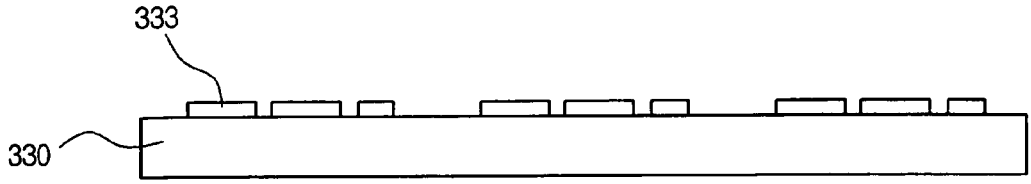

As shown in FIG. 6E, the etching-object layer 331 is etched with the resist pattern used for a mask, so that a desired pattern 333 may be formed. The formed pattern 333 corresponds to the grooves 323 formed on the mother cliché 320 in shape and number.

Finally, the substrate 330 is cut so as to correspond to each of the sizes of the first and the second sub-clichés 328 and 329, so that a plurality of panels may be obtained.

Though a printing process has been described using the grooves 323 formed on the cliché according to an embodiment of the present invention, there may exist a variety of methods such as a printing process using water absorption or non-water absorption and a printing process using a convex pattern formed on a cliche.

According to the foregoing present invention, if a defect such as a scratch is generated on part of the sub-cliché of the mother cliché including a plurality of the sub-clichés, it is possible to simply replace just the sub-cliché where the defect is generated, with a new one having the same groove on it. Accordingly, because the whole mother cliché does not need to be replaced, the processing costs may be remarkably reduced.

A further description thereof will be made in detail with reference to FIGS. 7A and 7B.

Figure 7A:
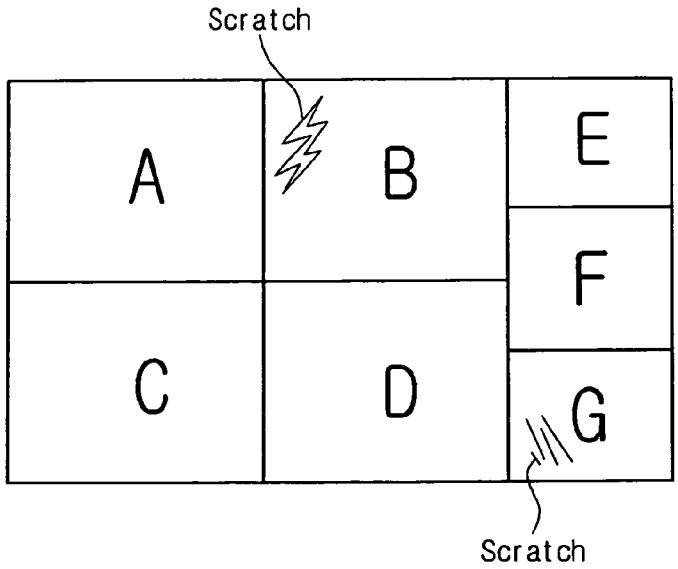
FIGS. 7A and 7B show a method for replacing a bad sub-cliché.
Figure 7B:
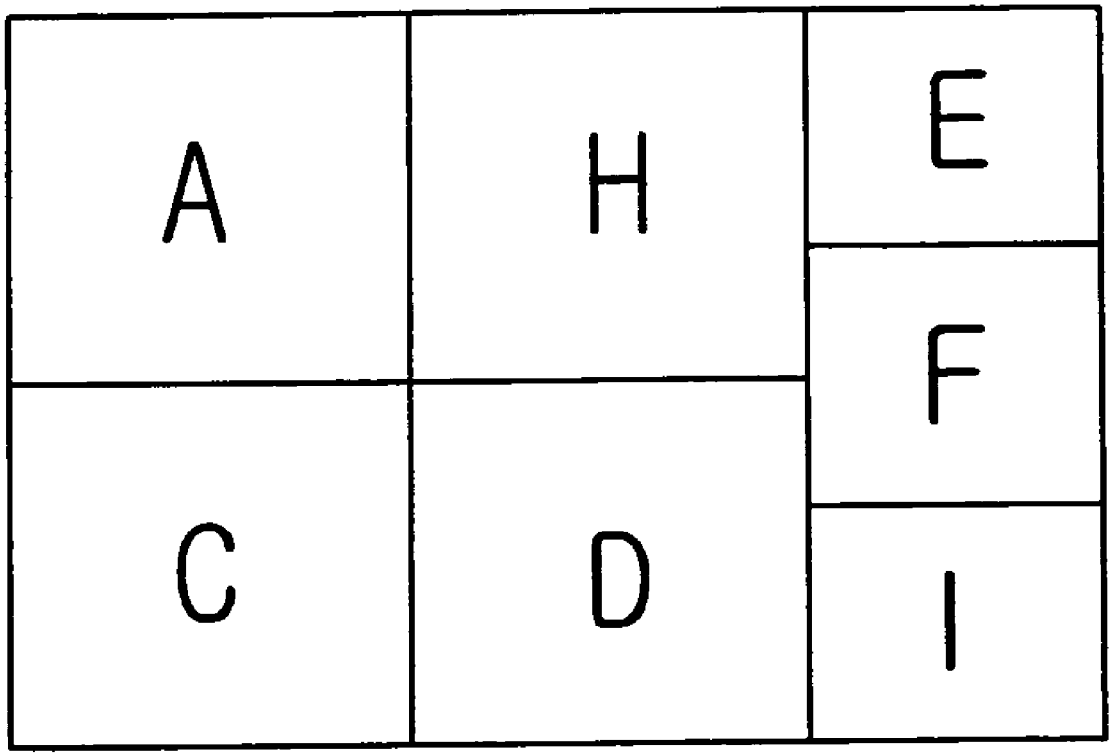

FIGS. 7A and 7B show a method for replacing a bad sub-cliché.

As shown in FIG. 7A, a scratch or a defect may be generated on a surface of part of the sub-clichés B and G due to friction with the doctor blade in the mother cliché including a plurality of sub-clichés A,B,C,D,E,F,G. If a printing process is performed using such a mother cliché where a scratch forms, a defect shaped like that scratch is transferred onto the substrate.

Therefore, it is desirable to prevent defects in the mother cliché.However, if a defect is formed in this manner in the related art, the entire cliché would have to be replaced. If the substrate is large, the cliché that corresponds thereto becomes large, so that if a defect is generated on the large cliché, the cliché has to be replaced by another large cliché. Hence, the processing costs may be increased considerably.

In the present invention, as shown in FIG. 7B, it is possible to eliminate a defect of the mother cliché by directly replacing the clichés B and G only, where the defects are formed, with new sub-clichés H and I having the same groove on them, without replacing the entire mother cliché. Accordingly, a printing process is performed on the substrate, using the mother cliché where no defect is generated, so that a desired resist pattern can be formed on the substrate without a defect.

Because each of the sub-clichés is aligned on a stage using a vacuum, the sub-clichés B and G where a defect is formed may be replaced by releasing the vacuum on sub-clichés B and G. Subsequently, after the sub-clichés B and G are replaced, alignment and the vacuum are resumed so that the mother cliché is fixed.

Also, according to the present invention, it is possible to manufacture a sub-cliché in various shapes depending upon panel models having different sizes, and to readily manufacture a mother cliché of a desired size by manufacturing a variety of the sub-clichés and tiling the same, regardless of the size of the mother cliché.

As is apparent from the foregoing, the present invention may be readily applied to any size substrate and may raise the manufacturing yield, by manufacturing a variety of sub-clichés depending on a panel model, and tiling these sub-clichés into a mother cliché.

The present invention can reduce the processing costs, reduce working time, and improve productivity, by replacing a sub-cliché only, where a defect is formed, with a new sub-cliché having the same groove pattern on it, if the defect is formed at part of the cliché in the mother cliché including a plurality of sub-clichés.

According to the present invention, because the mother cliché includes a plurality of sub-clichés having a relatively small size, a desired sub-cliché may be manufactured using related art photo equipment, whereby the processing cost may be remarkably reduced.

It will be apparent to those skilled in the art that various modifications and variations may be made in the present invention. Thus, it is intended that the present invention covers the modifications and variations of this invention provided they come within the scope of the appended claims and their equivalents.

What is claimed is:

1. A cliché unit comprising a mother cliché having a plurality of sub-clichés and being rolled by one roller, wherein each of the sub-clichés have grooves to print a pattern and wherein the plurality of sub-clichés include sub-clichés of a same size and sub-clichés of a different size, wherein a one-time rotation of the one roller has the same length as the mother cliché in a rotation direction of the one roller, wherein the sub-clichés are tiled each other to form the mother cliché , and wherein the mother cliché has a structure that a defect sub-cliché of the sub-clichés is replaced with a new sub-cliché.

2. The cliché unit according to claim 1, wherein the plurality of sub-clichés has the same size as each of corresponding panels to be manufactured using the cliché unit.

3. A printing apparatus comprising:

a mother cliché having a plurality of sub-clichés and being rolled by one roller, wherein each of the sub-clichés have grooves to print a pattern and wherein the plurality of sub-clichés include sub-clichés of a same size and sub-clichés of a different size;

a substrate on which panels are manufactured that correspond to the plurality of sub-clichés; and a printing means for printing the substrate using the mother cliché wherein a one-time rotation of the one roller has the same length as the mother cliché in a rotation direction of the one roller, wherein the sub-clichés are tiled each other to form the mother cliché, and wherein the mother cliché has a structure that a defect sub-cliché of the clichés is replaced with a new sub-cliché.

4. The apparatus according to claim 3, wherein the plurality of sub-c1ichés and the panels have the same size.

5. The apparatus according to claim 3, further comprising:

a doctor blade to fill the grooves on the mother cliché with a resist; and the roller that transfers the resist onto the substrate.

6. The apparatus according to claim 3, wherein an etching-object layer is formed on the substrate so that a pattern is formed with the resist on the substrate, and the resist is used as a mask.

7. A printing method using a printing apparatus, comprising the steps of:

forming a mother cliché having a plurality of sub-clichés and being rolled by one roller, wherein each of the sub-clichés have grooves to print a pattern and wherein the plurality of sub-clichés include sub-clichés of a same size and sub-clichés of a different size;

filling grooves of the mother cliché with a resist;

transferring the resist in the grooves onto the roller; and rolling the roller on a substrate so that the transferred resist is placed on the substrate, wherein a one-time rotation of the one roller has the same length as the mother cliché in a rotation direction of the one roller, wherein the sub-clichés are tiled each other to form the mother cliché, and wherein a defect sub-cliché of the sub-clichés is replaced with a new sub-cliché.

8. The method according to claim 7, wherein the step of forming the mother cliché includes:

manufacturing a plurality of sub-clichés with grooves corresponding to a printing pattern; and forming the mother cliché by tiling the plurality of sub-clichés each other.

9. The method according to claim 7 or claim 8, further including aligning the plurality of sub-clichés before tiling the plurality of sub-clichés.

10. The method according to claim 7, further including heating the resist formed on the substrate.

11. The method according to claim 7, wherein an etching-object layer is formed on the substrate.

12. The method according to claim 7, further including forming a pattern on the substrate that corresponds to the grooves by etching an etching-object layer with the transferred resist formed on the substrate used for a mask.

* * * * *